US005870909A

United States Patent [19]

Saunders, Jr. et al.

[11] Patent Number: 5,870,909

[45] Date of Patent: Feb. 16, 1999

[54] TAMPER RESISTANT LOCK

[76] Inventors: Daniel H. Saunders, Jr.; Margaret J. Saunders, both of P.O. Box 303, Brackettville, Tex. 78832

[21] Appl. No.: 925,102

[22] Filed: Sep. 8, 1997

[51] Int. Cl.[6] ..... E05B 37/14

[52] U.S. Cl. ..... 70/23; 70/26; 70/51; 70/312; 70/328

[58] Field of Search ..... 70/30, 304, 327, 70/328, 334, 333 R, 22–29, 50, 51, DIG. 23, 312, 323, 326, 463, 464

[56] References Cited

U.S. PATENT DOCUMENTS

| | | | |
|---|---|---|---|
| 18,157 | 9/1857 | Perry | 292/150 X |
| 135,992 | 2/1873 | Kittle | 70/25 |
| 178,250 | 6/1876 | Potter | 70/333 R |
| 425,451 | 4/1890 | Paige | 70/333 R |
| 530,551 | 12/1894 | Richards | 70/304 |
| 539,397 | 5/1895 | Goodhue | 70/293 |
| 599,765 | 3/1898 | Chase | 70/293 |
| 625,989 | 5/1899 | Snyder | 70/26 |
| 626,167 | 5/1899 | Katzenberger | 70/304 |
| 661,560 | 11/1900 | Stall | 70/288 |
| 783,351 | 2/1905 | Abernathy | 70/328 |
| 843,869 | 2/1907 | Clay | 70/328 |
| 1,295,543 | 2/1919 | McKay | 70/293 |
| 1,313,536 | 8/1919 | Jay | 70/327 |
| 1,314,426 | 8/1919 | Perdiue | 70/304 |
| 1,364,698 | 1/1921 | Brockup | 70/25 |
| 1,386,422 | 8/1921 | Ottinger | 292/150 X |
| 1,420,853 | 6/1922 | Long . | |
| 1,429,970 | 9/1922 | Roszmann . | |
| 1,445,719 | 2/1923 | Rozycki | 70/287 |
| 1,503,043 | 7/1924 | Greer . | |
| 1,546,333 | 7/1925 | Wortmann | 70/293 |
| 1,556,687 | 10/1925 | Haynes | 70/304 |
| 1,566,715 | 12/1925 | Winkler | 70/304 |
| 1,579,250 | 4/1926 | Schara | 70/25 |
| 1,597,837 | 8/1926 | Staley | 292/150 X |
| 1,618,841 | 2/1927 | McMenamin | 70/287 |
| 1,695,518 | 12/1928 | Watson | 70/413 |
| 1,737,477 | 11/1929 | Schmidt | 70/25 |
| 1,946,376 | 2/1934 | Whiting | 70/328 |
| 2,814,940 | 12/1957 | Miller | 70/333 R |
| 2,881,612 | 4/1959 | Smith et al. | 70/333 R |
| 3,115,028 | 12/1963 | Windle | 70/288 |
| 3,120,117 | 2/1964 | Maynard | 70/334 |
| 3,756,046 | 9/1973 | Jeh | 70/25 |
| 3,937,046 | 2/1976 | Wang | 70/81 |
| 4,114,408 | 9/1978 | Gee | 70/128 |
| 4,228,667 | 10/1980 | Herriott | 70/413 X |
| 4,646,547 | 3/1987 | Scelba et al. | 70/312 |
| 5,104,165 | 4/1992 | Anderson et al. | 292/337 |
| 5,186,032 | 2/1993 | Chia | 70/315 |

FOREIGN PATENT DOCUMENTS

| | | | |
|---|---|---|---|
| 372613 | 3/1923 | Germany | 70/293 |
| 380479 | 9/1923 | Germany | 70/304 |
| 508457 | 9/1930 | Germany | 70/26 |
| 805357 | 5/1951 | Germany | 70/26 |
| 2919609 | 11/1980 | Germany | 70/304 |
| 21487 | 5/1911 | Norway | 70/304 |
| 1227786 | 4/1986 | U.S.S.R. | 70/312 |
| 8284 | 6/1895 | United Kingdom | 70/304 |
| 883797 | 12/1961 | United Kingdom | 70/30 |

*Primary Examiner*—Lloyd A. Gall
*Attorney, Agent, or Firm*—Daniel V. Thompson

[57] ABSTRACT

A tamper resistant lock has the combination of compressed o-rings impeding rotation of a plurality of tumblers, false and real notches all having the same length, and hexagon heads on the tumblers to provide a durable and tamper resistant lock.

14 Claims, 3 Drawing Sheets

TAMPER RESISTANT LOCK

TECHNICAL FIELD

The present invention relates to locks, and more particularly to combination lock having a plurality of rotary tumblers.

BACKGROUND ART

A continuing security problem in the world today relates to shipping containers and transportation trailers. Highly valuable contents are secured by locks that are easily picked or cut off by professional burglars. The existing solution is an expensive, non-reusable lock that is nevertheless vulnerable to experienced thieves.

The lock of the present invention combines a unique structure that prevents cut-offs with friction masking and false notches to make a cut-off-proof, pick-proof lock that is simple, rugged, and effective.

Friction-masking is provided by eight (8) o-rings, one in front and back of each of four tumblers. The o-rings are trapped in counterbored rabbets in the lock body. When the lock is assembled, the tumbler from the front is press-fit with a retention pin coming into the lock body from the back, thus compressing both o-rings from both sides. The amount of compression on the o-rings is regulated by the depth of the rabbets in the lock body.

In most mechanical devices, o-rings are provided for fluid sealing. That is not the case here, as the sole purpose for compressing the o-rings on both ends of the tumblers is instead to dampen or remove the frictional feel of metal to metal that is created when the tumblers interact with the locking pin. Without the friction-masking provided by the compressed o-rings, there is a straight metal-to-metal feel when turning the tumblers, which greatly enhances a burglar's chance of gaining entry to the lock.

Viton™ o-rings must be used because they are resistant to all acids, solvents, petroleum products, heat, and cold, plus being extremely durable.

When the o-rings are compressed, all metal-to-metal feel is removed. The only way anything is felt is by pulling the locking pin out with great pressure. When this is done, the notches on some of the tumblers can be felt. To remedy this problem, we have cut the "unlock" notch of the tumbler with an end mill which has the same diameter of the locking pin, for example ⅜ inch, and we have also cut five additional false notches in the tumbler with a much smaller diameter end mill, for example ⅛ inch. The key, however, is to have all six notches the same length, which makes it impossible to tell the difference by feel. If the notches were not cut in the tumbler the same length distance, then there would not be the same feel on each and every one of them.

With the combination of the compressed o-rings and the false notches having the same length as the real notches, we have created a lock that we feel is absolutely impossible to open without the correct combination of numbers. In addition, when the o-rings under the tumblers are compressed, the tumblers are hard to turn. By doing this the lock gains additional advantages. The o-rings require that the tumblers on this lock be machined from hexagon stock, leaving the hexagon head as the only external part of the tumbler. This design serves two very useful purposes. The first being that, because of the o-rings, a wrench is required to turn the tumblers. The great advantage in this is in sub-freezing weather or extremely dirty conditions or if the lock has been damaged from physical attack. By using the wrench, the lock will still operate. The second great advantage is that these heads, as opposed to a dials or knobs on all other combination locks, cannot be easily damaged from physical attack or adverse weather conditions. It would be almost impossible to damage one of these heads to the point it would not operate.

The combination of the compressed o-rings, false and real notches all having the same length, and the hexagon heads on the tumblers makes this the most unique, most durable and best lock on the market today.

When combined with a cut-off-proof structure, the lock meets every need and is unremovable except with the right combination or a welding torch. The cut-off-proof structure will now be described.

The only single pin lock in use anywhere in the world to our knowledge, is not a lock, but rather a casehardened bolt that is put through the hasp of trailers and containers and then there is a head press fined on the end with a special tool. This is the lock used by almost all shipping companies worldwide today. There are two large draw-backs to using this type of lock, one is, it can only be used once, because when the shipment gets to its destination it has to be cut off with a large set of bolt cutters. This causes a big inconvenience for the shipper and receiver. The other drawback is the bolt is so hard and brittle that a burglar can put a large wrench or cheater pipe on it and bend it just a little and it will break. Our lock, on the other hand, has a stainless steel locking pin that will bend but not break. Stainless steel has one of the highest tensile strengths of any metal but yet is not brittle. Another great advantage of using a single locking pin such as ours is the fact that the neck can be made any length to custom fit any existing hasp yet leave no room for thieves to cut it off with bolt cutters, etc. No other lock in use today, to our knowledge, possesses this advantage.

SUMMARY OF THE DISCLOSURE

The combination of compressed o-rings impeding rotation of the tumblers, false and real notches all having the same length, and hexagon heads on the tumblers provides a durable and tamper resistant lock.

BRIEF DESCRIPTION OF THE DRAWINGS

A more complete understanding of the invention and its advantages will be apparent from the Detailed Description taken in conjunction with the accompanying Drawings, in which.

DETAILED DESCRIPTION OF THE PREFERRED EMBODIMENT

Figure 1:
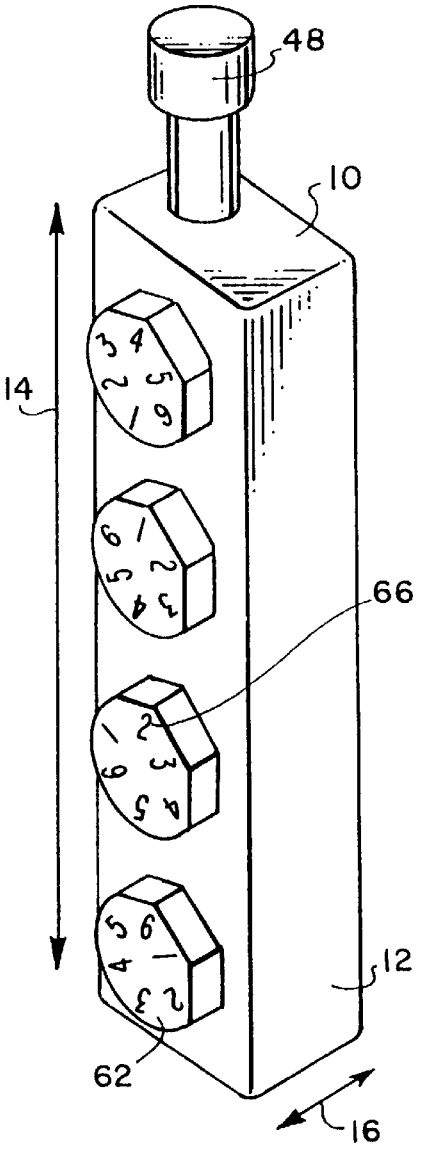
FIG. 1 is a perspective view of the lock.
Figure 2:
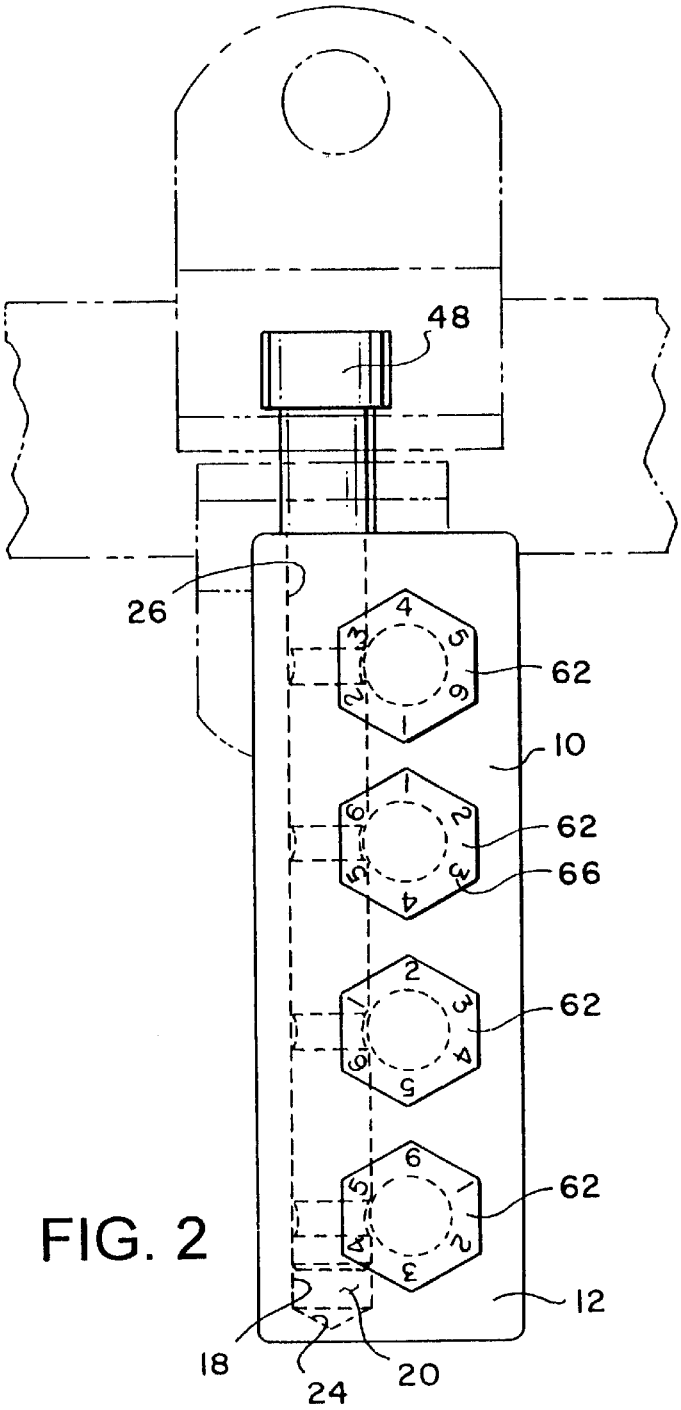
FIG. 2 is a front view of the lock with a typical trailer hasp mechanism in phantom.
Figure 3:
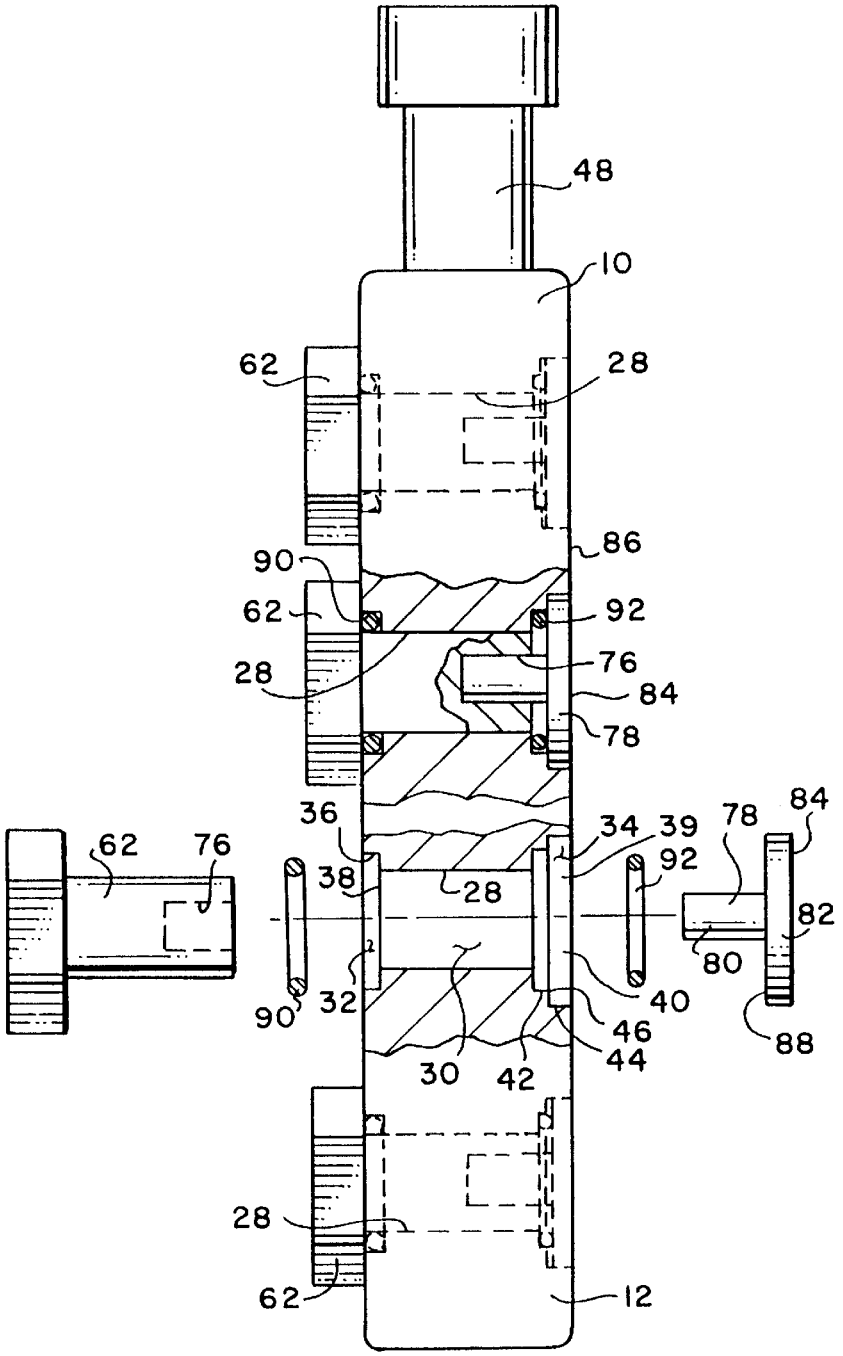
FIG. 3 is a partially exploded view.
Figure 4:
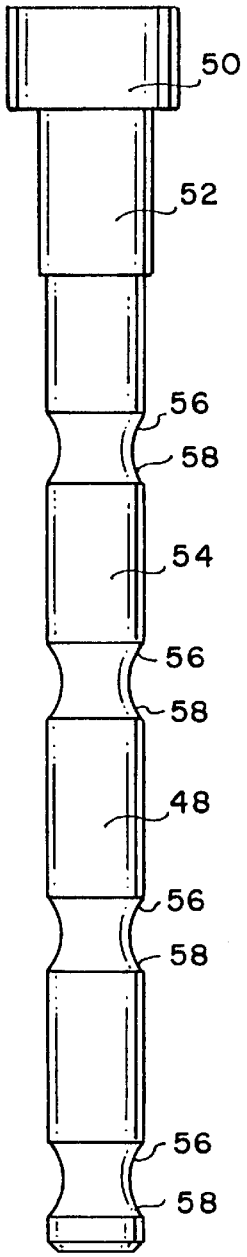
FIG. 4 is a side view of the locking pin.
Figure 5:
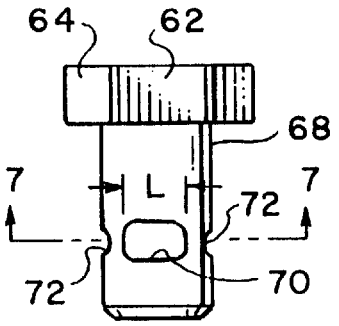
FIG. 5 is a side view of a tumbler showing the deep transverse groove.
Figure 6:
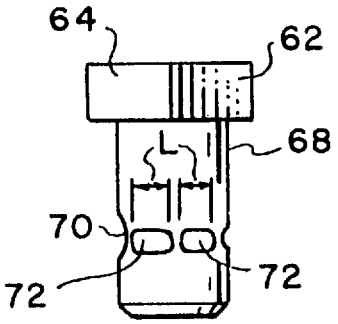
FIG. 6 is a view similar to FIG. 5 rotated ninety degrees and showing two shallow transverse grooves.
Figure 7:
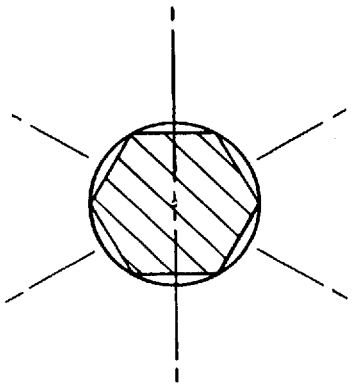
FIG. 7 is a section view taken along lines 7—7 of FIG. 5.

The preferred embodiment of the lock 10 includes a rectangular lock body 12 having a long direction indicated by arrow 14 and a thin direction perpendicular to the long direction indicated by arrow 16. Lock body 12 has a wall 18 defining an offset, cylindrical longitudinal bore 20 in the long direction. Longitudinal bore 20 has a closed end 24 and an open end 26.

The lock body also has walls 28 defining four, equal-diameter, cylindrical, transverse bores 30 in the thin direction. The transverse bores 30 are linearly aligned in the long direction, with the walls 28 of the transverse bores intersecting the wall 18 of the longitudinal bore 20. Each transverse bore 30 has first and second open ends 32, 34.

Each transverse bore 30 also has a wall 36 defining a first groove 38. First groove 38 is a single cylindrical rabbet at the first end 32. A wall 39 defines a second groove 40, being a double cylindrical rabbet at the second end 34. Each double rabbet has inner and outer rabbets 42, 44 connected by a common edge 46, with the outer rabbet 44 being of a larger diameter than the inner rabbet 42.

A locking pin 48 is removably engaged for linear motion with the longitudinal bore 20. The locking pin 48 is a long, generally-cylindrical body terminating at an enlarged-diameter head 50 joined to a lock shank 52. The head 50 and lock shank 52 extend from the longitudinal bore 20 exterior to the lock body 12. The locking pin 48 also has a reduced-diameter, cylindrical, interior portion 54 joined to the lock shank 52, with walls 56 in the interior portion 54 defining locking pin grooves 58. The locking pin grooves 58 are four semi-toroidal rabbets spaced to correspond with the transverse bores 30.

Four tumblers 62 are fixed for rotary motion in the transverse bores 30. Each tumbler 62 has an exterior, hexagonal head 64 with six, equally-spaced indicia marks 66 formed thereon. Each tumbler also has an interior, cylindrical surface 68 engaged with a transverse bore 30. The cylindrical surface 68 has one deep transverse groove 70 and five shallow transverse grooves 72. The transverse grooves 70, 72 are equally-spaced about the tumbler 62 to correspond with the indicia marks 66.

The deep transverse groove 70 is sized to permit passage of the locking pin 48 when the tumbler 62 is rotated to a pre-determined "unlock" position corresponding to one of the indicia marks 66. The five shallow transverse grooves 72 are sized equal length "L" to the deep transverse groove to simulate release of the locking pin 48 when the tumbler 62 is in any of five "lock" positions corresponding to the other five of the indicia marks 66.

The tumblers 62 each have walls defining a cylindrical interior bore 76 on an end opposite the hexagonal head 64. A retention pin 78 has an interior portion 80 press-fit into each of the tumbler interior bores 76, with each retention pin 78 having an enlarged diameter disc-shaped end 82 opposite the interior portion 80. The disc-shaped end 82 has an outer surface 84 flush with a back surface 86 of the lock body 12, and the inner surface 88 thereof is engaged with the outer rabbet 44 of the double rabbet of the transverse bore second end 34.

A first Viton™ o-ring 90 is trapped by the hexagonal head 64 of each tumbler 62 in the single rabbet of the first end 32 of each transverse bore 30. A second Viton™ o-ring 92 is trapped by each disc-shaped end 82 of the retention pin 78 in the inner rabbet 42 of the double rabbet of the transverse bore second end 34. The single and double rabbets and the o-rings 90, 92 are sized such that the o-rings are compressed and frictionally impede rotation of the tumblers 62 in the transverse bores 30.

Whereas, the present invention has been described with respect to a specific embodiment thereof, it will be understood that various changes and modifications will be suggested to one skilled in the art, and it is intended to encompass such changes and modifications as fall within the scope of the appended claims.

We claim:

1. A lock apparatus, comprising:

a lock body having a long direction and a thin direction perpendicular to the long direction;

the lock body having a wall defining a longitudinal bore in the long direction;

the lock body having walls defining a plurality of transverse bores in the thin direction, the transverse bores being linearly aligned in the long direction, with the walls of the transverse bores intersecting the wall of the longitudinal bore, and the transverse bores having first and second open ends;

each transverse bore having a wall defining a first groove at the first end and walls defining a second groove at the second end;

a locking pin removably engaged for linear motion with the longitudinal bore and having a lock shank extending from the longitudinal bore exterior to the lock body;

the locking pin having an interior portion joined to the lock shank, with walls in the interior portion defining locking pin grooves spaced to correspond with the transverse bores;

a plurality of tumblers fixed for rotary motion in the transverse bores;

each tumbler having an exterior head with a plurality of indicia marks formed thereon;

each tumbler having an interior, cylindrical surface engaged with one of the transverse bores, the tumbler cylindrical surface having one deep transverse groove and a plurality of shallow transverse grooves, the transverse grooves being spaced about the tumbler to correspond with the indicia marks;

the deep transverse groove sized to permit passage of the locking pin when the tumbler is rotated to a predetermined "unlock" position corresponding to one of the indicia marks, and the shallow transverse grooves sized equal length to the deep transverse groove to simulate release of the locking pin when the tumbler is in any of "lock" positions corresponding to all of the indicia marks except the said one indicia mark corresponding to the "unlock" position;

a retention pin for each of the tumblers, with each retention pin having an enlarged diameter disc-shaped external end;

a first o-ring trapped by the exterior head of each tumbler in the first groove of each transverse bore, and a second o-ring trapped by the disc-shaped external end of the retention pin in the second groove of each transverse bore; and the transverse bore first and second grooves and the o-rings being sized such that the o-rings are compressed and frictionally impede rotation of the tumblers in the transverse bores.

2. The apparatus of claim 1 with a rectangular lock body.

3. The apparatus of claim 2 with an offset, cylindrical longitudinal bore.

4. The apparatus of claim 1 with the longitudinal bore having a closed end and an open end, and the locking pin extending out of the open end.

5. The apparatus of claim 1 with four, equal-diameter, cylindrical transverse bores, and four tumblers.

6. The apparatus of claim 1 with the tumbler exterior heads being hexagonal, with six, equally-spaced indicia marks.

7. The apparatus of claim 1 with the transverse bore first groove being a single cylindrical rabbet and the transverse bore second groove being a double cylindrical rabbet.

8. The apparatus of claim 7 with the double rabbet having inner and outer rabbets connected by a common edge, with the outer rabbet being of a larger diameter than the inner rabbet.

9. The apparatus of claim 1 with the locking pin being a long, generally-cylindrical body terminating at an enlarged-diameter head joined to the lock shank, the head and lock shank extending from the longitudinal bore exterior to the lock body.

10. The apparatus of claim 9 with the locking pin interior portion being a reduced-diameter, cylindrical, surface.

11. The apparatus of claim 1 with the locking pin grooves being four semi-toroidal rabbets.

12. The apparatus of claim 1 with five shallow transverse grooves.

13. The apparatus of claim 1 with the tumblers each having a wall defining a cylindrical interior bore on an end opposite the exterior head, and the retention pin having an interior portion press-fit into each of the tumbler interior bores, and with each retention pin having an outer surface flush with a back surface of the lock body and being engaged with an outer rabbet of a double rabbet of the transverse bore second end.

14. A lock, comprising:

a rectangular lock body having a long direction and a thin direction perpendicular to the long direction;

the lock body having a wall defining an offset, cylindrical longitudinal bore in the long direction, the longitudinal bore having a closed end and an open end;

the lock body having walls defining four, equal-diameter, cylindrical, transverse bores in the thin direction, the transverse bores being linearly aligned in the long direction, with the walls of the transverse bores intersecting the wall of the longitudinal bore, and the transverse bores having first and second open ends;

each transverse bore having a wall defining a first groove, the first groove being a single cylindrical rabbet at the first end, and walls defining a second groove, the second groove being a double cylindrical rabbet at the second end, the double rabbet having inner and outer rabbets connected by a common edge, with the outer rabbet being of a larger diameter than the inner rabbet;

a locking pin removably engaged for linear motion with the longitudinal bore;

the locking pin being a long, generally-cylindrical body terminating at an enlarged-diameter head joined to a lock shank, the head and lock shank extending from the longitudinal bore exterior to the lock body;

the locking pin having a reduced-diameter, cylindrical, interior portion joined to the lock shank, with walls in the interior portion defining locking pin grooves, the locking pin grooves being four semi-toroidal rabbets spaced to correspond with the transverse bores;

four tumblers fixed for rotary motion in the transverse bores;

each tumbler having an exterior, hexagonal head with six, equally-spaced indicia marks formed thereon;

each tumbler having an interior, cylindrical surface engaged with a transverse bore, the cylindrical surface having one deep transverse groove and five shallow transverse grooves, the transverse grooves being equally-spaced about the tumbler to correspond with the indicia marks;

the deep transverse groove sized to permit passage of the locking pin when the tumbler is rotated to a predetermined "unlock" position corresponding to one of the indicia marks, and the five shallow transverse grooves sized equal length to the deep transverse groove to simulate release of the locking pin when the tumbler is in any of five "lock" positions corresponding to five of the indicia marks;

the tumblers each having a wall defining a cylindrical interior bore on an end opposite the hexagonal head;

a retention pin having an interior portion press-fit into each of the tumbler interior bores, with each retention pin having an enlarged diameter disc-shaped end opposite the interior portion, the disc-shaped end having an outer surface flush with a back surface of the lock body and being engaged with the outer rabbet of the double rabbet of the transverse bore second end;

a first o-ring trapped by the hexagonal head of each tumbler in the single rabbet of the first end of each transverse bore, and a second o-ring trapped by each disc-shaped end of the retention pin in the inner rabbet of the double rabbet of the transverse bore second end; and the single and double rabbets and the o-rings being sized such that the o-rings are compressed and frictionally impede rotation of the tumblers in the transverse bores.

* * * * *